US006734752B2

(12) United States Patent
Takei

(10) Patent No.: US 6,734,752 B2
(45) Date of Patent: May 11, 2004

(54) NONRECIPROCAL CIRCUIT DEVICE AND COMMUNICATION APPARATUS

(75) Inventor: Hideo Takei, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 29 days.

(21) Appl. No.: 10/153,202

(22) Filed: May 23, 2002

(65) Prior Publication Data

US 2002/0180551 A1 Dec. 5, 2002

(30) Foreign Application Priority Data

May 31, 2001 (JP) ..... 2001-165577

(51) Int. Cl.[7] ..... H01P 1/32
(52) U.S. Cl. ..... 333/1.1; 333/24.2
(58) Field of Search ..... 333/1.1, 24.2

(56) References Cited

U.S. PATENT DOCUMENTS 5,223,805 A * 6/1993 Talcott et al. ..... 333/1.1
5,620,543 A * 4/1997 Marusawa et al. ..... 156/89.12
5,945,887 A * 8/1999 Makino et al. ..... 333/1.1
6,462,628 B2 * 10/2002 Kondo et al. ..... 333/24.2
6,512,424 B2 * 1/2003 Furuya et al. ..... 333/1.1
6,570,466 B1 * 5/2003 Bahl ..... 333/128

* cited by examiner

*Primary Examiner*—Michael J. Tokar
*Assistant Examiner*—Linh V Nguyen
(74) *Attorney, Agent, or Firm*—Keating & Bennett, LLP

(57) ABSTRACT

A concentrated constant type isolator includes an upper member, a lower member, a resin case, a center electrode assembly, a permanent magnet, a resistor element, matching capacitor elements, and a resin member. By setting the electrostatic capacitance value of the matching capacitor element on the input terminal side and that on the output terminal side to appropriate values, the reflection loss characteristic of the concentrated constant type isolator is set such that the center frequency in a pass band is located between the frequency at which the input-side reflection loss becomes a maximum value and the frequency at which the output-side reflection loss becomes a maximum value, and such that the frequency at which insertion loss becomes the minimum value is close to the center frequency, whereby the standard of the insertion loss is satisfied.

21 Claims, 10 Drawing Sheets

FREQUENCY (MHz)
INSERTION LOSS STANDARD
INSERTION LOSS
REFLECTION LOSS
(dB)
F0
F1
F2
F3
S11
S21
S22
d1
d2
d3
d4
d5
0
50
∞

FREQUENCY (MHz)
INSERTION LOSS STANDARD
INSERTION LOSS
REFLECTION LOSS
(dB)
F0
F3
F1
F2
S21
S22
S11 d2
d1 d5
d4
d3

NONRECIPROCAL CIRCUIT DEVICE AND COMMUNICATION APPARATUS

BACKGROUND OF THE INVENTION

1. Field of the Invention

The present invention relates to a nonreciprocal circuit device and a communication apparatus including such a nonreciprocal circuit device.

2. Description of the Related Art

In general, a nonreciprocal circuit device includes a permanent magnet, a center electrode assembly to which a DC magnetic field is applied by the permanent magnet, a metallic case that accommodates the permanent magnet and the center electrode assembly, and matching capacitors electrically connected to the center electrode assembly.

In related nonreciprocal circuit devices, the pass characteristic and the reflection loss were regarded as important matters, and these devices were designed so that, at the center frequency in a pass band, the insertion loss was at a minimum value and the input/output reflection losses became a maximum value. On the other hand, the impedance of the nonreciprocal circuit device from the input terminal side (hereinafter referred to as "input impedance") was regarded as an important matter compared with the pass characteristic and the reflection characteristic, and the standard of the input impedance was hardly considered in the design. That is, in the related nonreciprocal circuit devices, an electronic capacitance of the matching capacitors was set so that, the insertion losses became the minimum value at the frequency as well as the input/output reflection losses became the maximum value thereof, and consequently, the input impedances thereof were automatically set.

When the related nonreciprocal circuit device designed as described above was included in a communication apparatus such as a portable telephone, impedance matching between the nonreciprocal circuit device and a next-stage electric circuit might not be achieved. It was therefore, necessary to adjust the input impedance of the nonreciprocal circuit device by changing the electrostatic capacities of the matching capacitors thereof in order to achieve impedance matching. However, when the input impedance of the nonreciprocal circuit device was adjusted, the frequency at which the input-side reflection loss became the maximum value deviated significantly from the center frequency, and consequently, the frequency at which the insertion loss became the minimum value also deviated significantly from the center frequency, whereby a specification that a customer demanded might not be satisfied.

SUMMARY OF THE INVENTION

In order to overcome the problems described above, preferred embodiments of the present invention provide a nonreciprocal circuit device and a communication apparatus that allow the input impedances to be set at desirable values without changing the characteristics of the inner components and that satisfy the required insertion loss.

According to a preferred embodiment of the present invention, a nonreciprocal circuit device includes a first frequency at which the input-side reflection loss becomes a maximum value is set to be lower or higher than the center frequency in a pass band, a second frequency at which the output-side reflection loss becomes a maximum value is set to be higher or lower than the center frequency, the center frequency is located between the first frequency and the second frequency.

More specifically, the present invention provides a nonreciprocal circuit device that includes a permanent magnet, a center electrode assembly which has a ferrite member, and a plurality of center electrodes disposed on the surface of the ferrite member so as to cross each other at predetermined angles, and to which a DC magnetic field is applied by the permanent magnet, a metallic case that has the permanent magnet and the center electrode assembly disposed therein, matching capacitors electrically connected to the center electrode assembly, and by adjusting the electrostatic capacitance of the matching capacitors, or by adjusting the crossing angles between the center electrodes, a first frequency at which the input-side reflection loss becomes a maximum value is set to be lower or higher than the center frequency in a pass band, a second frequency at which the output-side reflection loss becomes a maximum value is set to be higher or lower than the center frequency, the center frequency is located between the first frequency and the second frequency.

With these characteristics, when input impedance matching of the nonreciprocal circuit device is to be performed, the electrostatic capacities of the matching capacitors or the crossing angles between the center electrodes are appropriately adjusted so that the center frequency in a pass band is located between the frequency at which the input-side reflection loss becomes the maximum value and the frequency at which the output-side reflection loss becomes the maximum value. Thereby, the frequency at which insertion loss becomes the minimum value is close to the center frequency, thereby satisfying the insertion loss standard.

Also, the communication apparatus according to another preferred embodiment of the present invention, which is equipped with the nonreciprocal circuit device having the above-described features, achieves greatly improved impedance matching between the nonreciprocal circuit device and a next-stage electric circuit, and has a reduced power consumption.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
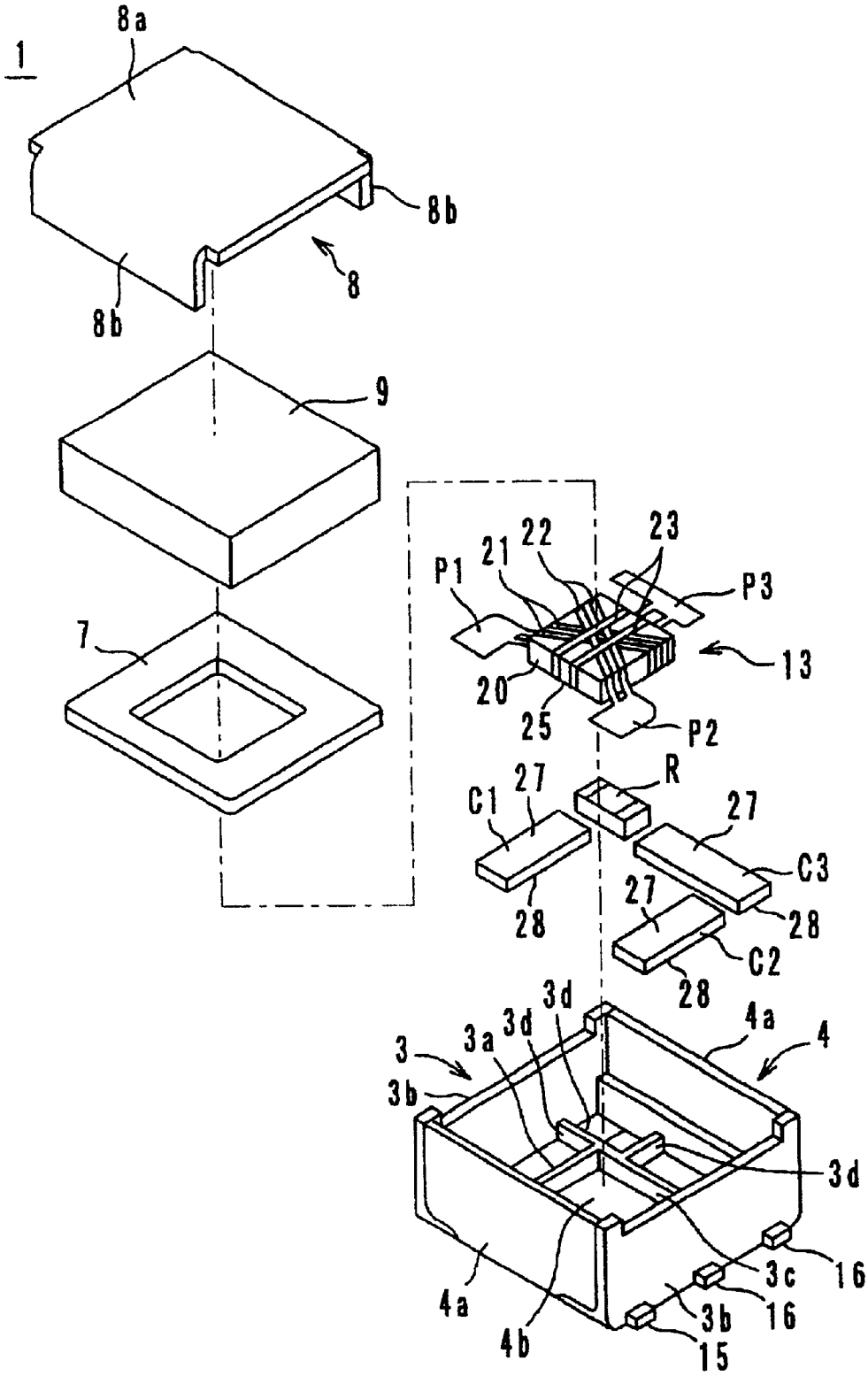
FIG. 1 is an exploded perspective view showing a nonreciprocal circuit device according to a preferred embodiment of the present invention.

FIG. 1 is an exploded perspective view showing the nonreciprocal circuit device according to a preferred embodiment of the present invention. This nonreciprocal circuit device 1 is preferably a concentrated constant type isolator.

Referring to FIG. 1, the concentrated constant type isolator 1 preferably includes an upper member 8, a lower member 4, a resin case 3, a center electrode assembly 13, a permanent magnet 9, a resistor element R, matching capacitors C1 to C3, and a resin member 7.

The lower member 4 has right and left side walls 4*a*, and a bottom wall 4*b*. This lower member 4 is preferably integrally molded with the resin case 3 by an insert molding method. Two ground terminals 16 extend from each of a pair of opposite sides of the bottom wall 4*b* in the lower member 4 (here, two ground terminals on the rear side are not shown). The upper member 8 preferably has a substantially rectangular shape in a plan view, and has an upper wall 8*a* and right and left walls 8*b*. The lower member 4 and the upper member 8 are, for example, formed by punching a plate material constituted of a material having a high permeability, such as Fe or silicon steel, and after being bent, they are plated with Cu as a base layer and then plated with Ag on the Cu layer.

The center electrode assembly 13 is arranged so that three center electrodes 21 to 23 are disposed on the top surface of a microwave ferrite member 20 having a substantially rectangular shape in a plan view so as to cross one another at angles of approximately 120 degrees, with insulating sheets (not shown) interposed therebetween. The center electrodes 21 to 23 are arranged so that port portions P1 to P3 of one-end sides thereof are led out horizontally, and such that a ground electrode 25, which is common to the center electrodes 21 to 23 and which is on the other end side thereof, is abutted against the bottom surface of the ferrite member 20. The common ground electrode 25 covers substantially the entire bottom surface of the ferrite member 20, and is connected to the bottom wall 4*b* of the lower member 4 by a method such as soldering, for example, through a window portion 3*c* in the resin case 3 described later, for grounding. The center electrodes 21 to 23 and the ground electrode 25 are preferably made of a conductive material such as Ag, Cu, Au, Al, Be or other suitable material, and are integrally formed preferably by punching a metallic thin plate, or by etching work.

The matching capacitor elements C1 to C3 are arranged so that hot-side electrodes 27 thereof located on the top surface of a dielectric ceramic substrate are electrically connected to the port portions P1 to P3, respectively, while cold-side (ground side) electrodes 28 located on the bottom surface thereof are each soldered to the bottom wall 4*b* of the lower member 4 and are exposed at the window portions 3*d* of the resin case 3.

Figure 3:
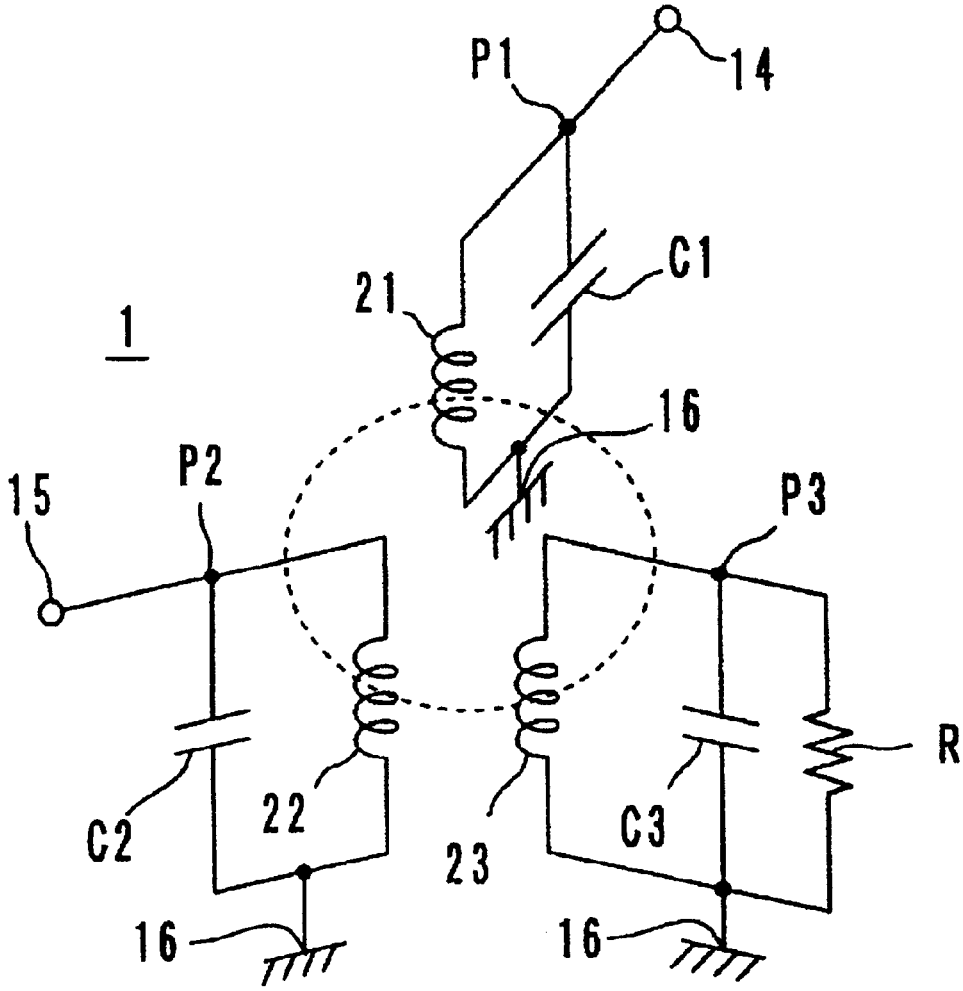
FIG. 3 is an electrical equivalent circuit of the nonreciprocal circuit device in FIG. 1.

The resistor element R is arranged so that one terminal electrode thereof is soldered to the bottom wall 4*b* of the lower member 4 and exposed at the window portions 3*d* of the resin case 3, while the other terminal electrode thereof is soldered to the port portion P3. That is, as shown in FIG. 3, the matching capacitor element C3 and the resistor element R are electrically coupled in parallel between the port portion P3 of the center electrode 23 and the ground electrode 16.

As shown in FIG. 1, the resin case 3 has a bottom portion 3*a* and two side portions 3*b*. A window portion 3*c* having a substantially rectangular shape in a plan view is formed in the approximate central portion of the bottom portion 3*a*, and at the peripheral portion of the window portion 3*c*, there are provided the window portions 3*d* within which the matching capacitors C1 to C3 and the resistor element R are to be disposed. The bottom wall portion 4*b* of the lower member 4 is exposed at the window portions 3*c* and 3*d*. An input terminal 14 and an output terminal 15 (see FIG. 3) are insert-molded to the resin case 3. The input terminal 14 and the output terminal 15 are arranged such that one-side ends thereof are exposed at the outer surface of the resin case 3, and such that the other ends thereof are exposed at the bottom portion 3*a* of the resin case 3, thereby forming an input lead-out electrode and an output lead-out electrode, respectively. Ground terminals 16 are led out from the opposite side surfaces of the resin case 3 in the outward direction.

Figure 2:
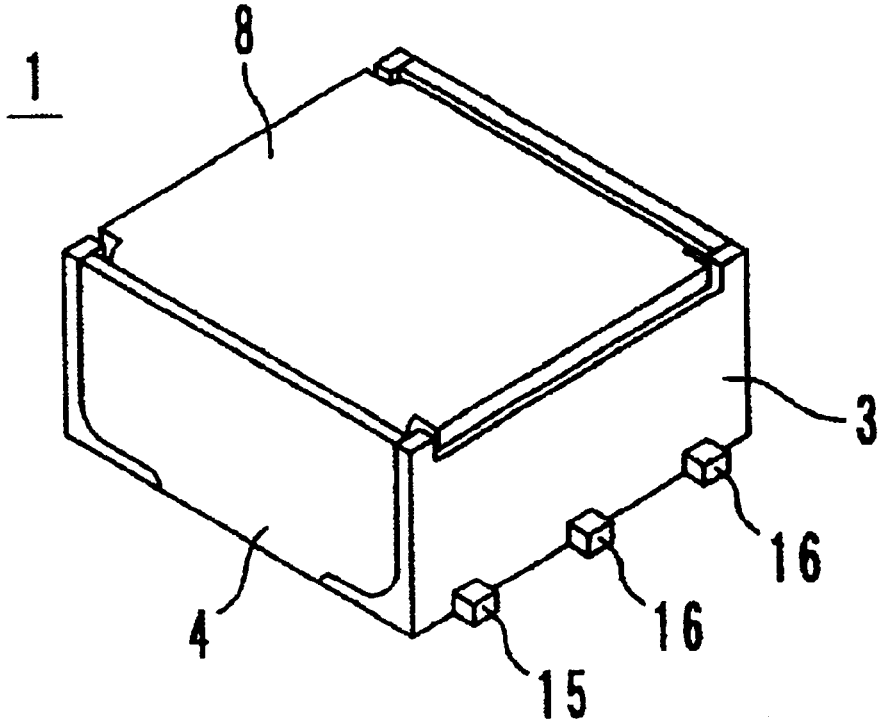
FIG. 2 is an external perspective view showing the nonreciprocal circuit device in FIG. 1.

The above-described components are arranged such that the center electrode assembly 13, the matching capacitor elements C1 to C3, and the resistor element R are disposed in the resin case 3, which is integrally molded with the lower member 4, and such that, after the resin member 7 and the permanent magnet 9 are stacked on the above-mentioned matching capacitors and resistor element, the upper member 8 is mounted. The permanent magnet 9 applies a DC magnetic field to the center electrode assembly 13. The lower member 4 and the upper member 8 define a metallic case by being joined by soldering or other suitable method, constitute a magnetic circuit, and also function as a yoke. In this manner, the concentrated constant type isolator 1 shown in FIG. 2 is produced. FIG. 3 is an electrical equivalent circuit of the concentrated constant type isolator 1.

Next, the operation of the concentrated constant type isolator 1 will be described, taking the case where the isolator 1 is built into the RF (radio frequency) portion of the portable telephone 120 shown in FIG. 4 as an example.

Figure 4:
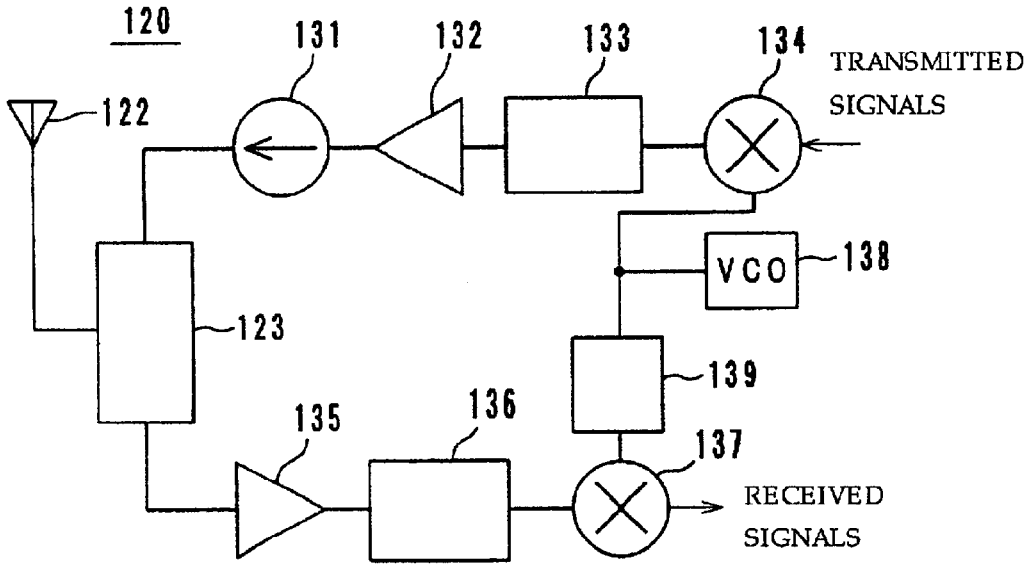
FIG. 4 is a block diagram showing a preferred embodiment of a communication apparatus according to the present invention.

FIG. 4 is an electric circuit block diagram of the RF portion of the portable telephone 120.

Referring to FIG. 4, reference numeral 122 denotes an antenna element, 123 denotes a duplexer, 131 denotes an isolator for transmission, 132 denoted a transmission-side amplifier, 133 denotes a transmission-side interstage band pass filter, and 134 denotes a transmission-side mixer, 135 denotes a reception-side amplifier, 136 denotes a reception-side interstage band pass filter, 137 denotes a reception-side mixer, 138 denotes a voltage-controlled oscillator (VCO), and 139 denotes a local band pass filter.

Figures 5A, 5B, 5C:
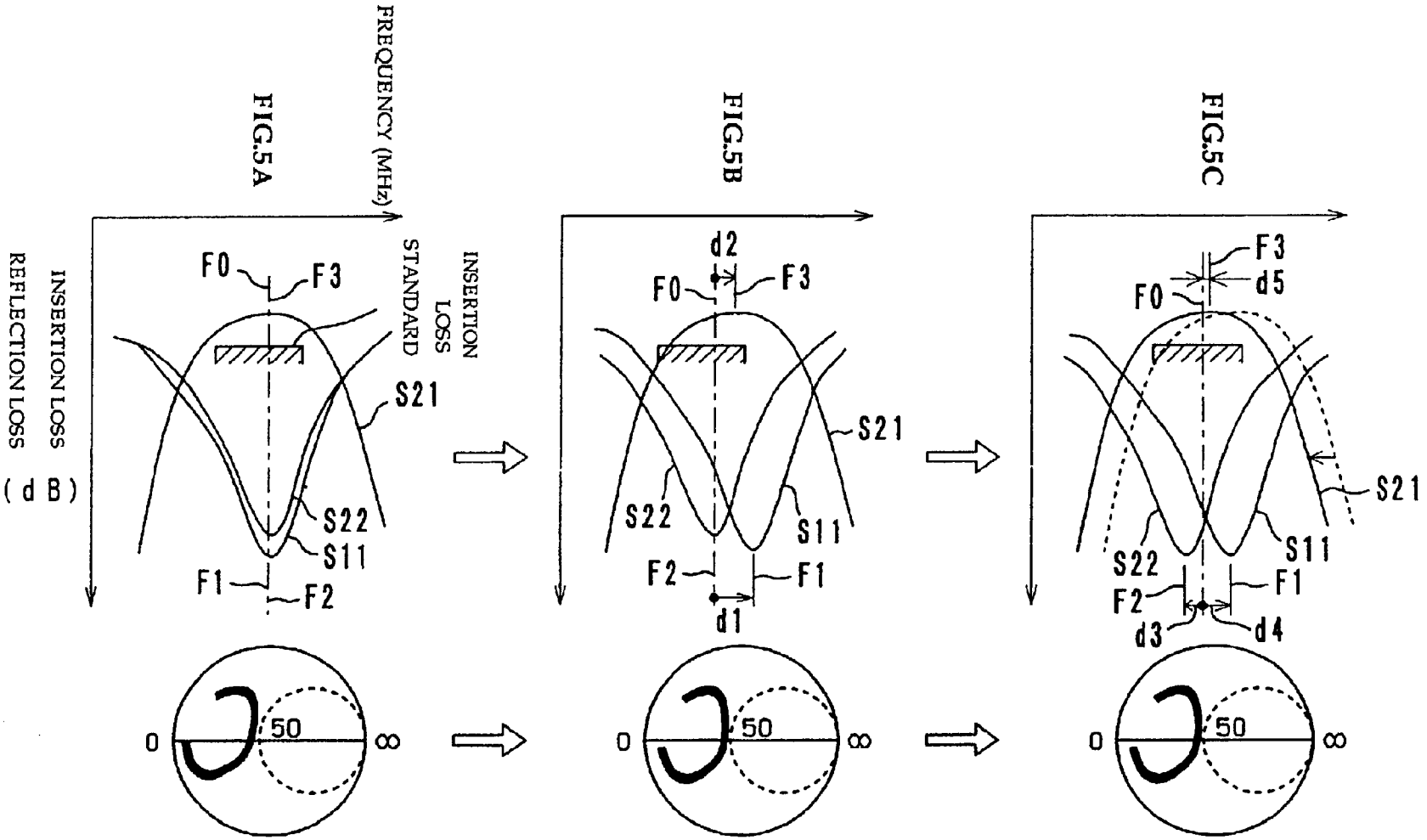
FIGS. 5A to 5C are diagrams showing the input impedance matching of the nonreciprocal circuit device in FIG. 1.

Here, as the isolator for transmission 131, the above-described concentrated constant type isolator 1 is preferably used. FIG. 5A shows the electrical characteristics of the related nonreciprocal circuit device (the upper section) and the Smith chart therefor (the lower section). As can be seen from FIG. 5A, regarding the pass characteristic and reflection characteristic as important, the electrostatic capacities of the matching capacitors C1 to C3 are set such that the insertion loss S21 becomes a minimum value at the center frequency F0, and such that the input-side reflection loss S11 and the output-side reflection loss S22 become the maximum value. This related isolator might not achieve impedance matching with the transmission-side amplifier 132.

In this case, an idea that, in order to achieve impedance matching, the impedance value of the isolator is set at a desirable value (i.e., a large value) by changing (i.e., reducing) only the electrostatic capacitance of the matching capacitor element C1 on the input terminal 14 side in the equivalent circuit in FIG. 3 to an appropriate value, will be considered. However, as shown in FIG. 5B, in such setting, the frequency Fl at which the input-side reflection loss S11 becomes the maximum value might deviate from the center frequency F0 toward the higher frequency side by dl, and consequently, the frequency F3 at which the insertion loss S21 becomes the minimum value might also deviate from the center frequency F0 toward the higher frequency side by d2. This causes the problem that the insertion loss S21 falls outside the desired or required insertion loss.

Accordingly, in the isolator 1 according to a preferred embodiment of the present invention, the input impedance value of the isolator 1 is preferably set at a desirable value by changing the electrostatic capacitance value of the matching capacitor element C1 and also that of the matching capacitor element C2 on the output terminal 15 side to appropriate values. Specifically, as shown in FIG. 5C, by increasing the electrostatic capacitance of the matching capacitor element C2, the frequency F2 at which the output-side reflection loss S22 becomes the maximum value is caused to be lower than the center frequency F0 in a pass band by d3. Furthermore, by decreasing the electrostatic capacitance of the matching capacitor element C1, the frequency Fl at which the input-side reflection loss S11 becomes the maximum value is caused to be higher than the center frequency F0 by d4 (<d1). Thereby, the frequency F3 at which the insertion loss S21 becomes the minimum has only to deviate from the center frequency F0 slightly, and more specifically, by d5 (<d2). That is, with respect to the reflection loss characteristic, by setting the center frequency F0 so as to be located between the frequency F1 at which the input-side reflection loss S11 becomes the maximum and the frequency F2 at which the output-side reflection loss S22 becomes the maximum, the frequency F3 at which the insertion loss S21 becomes the minimum value can be brought close to the center frequency F0, thereby allowing the required insertion loss to be satisfied.

In this manner, by incorporating the isolator 1 of which the input impedance value has been set so as to achieve matching with the impedance value of the transmission-side amplifier 132, into a portable telephone 120, it is possible to achieve a portable telephone 120 that has greatly improved impedance matching with the transmission-side amplifier 132 and that has a reduced power consumption.

Figures 6A, 6B, 6C:
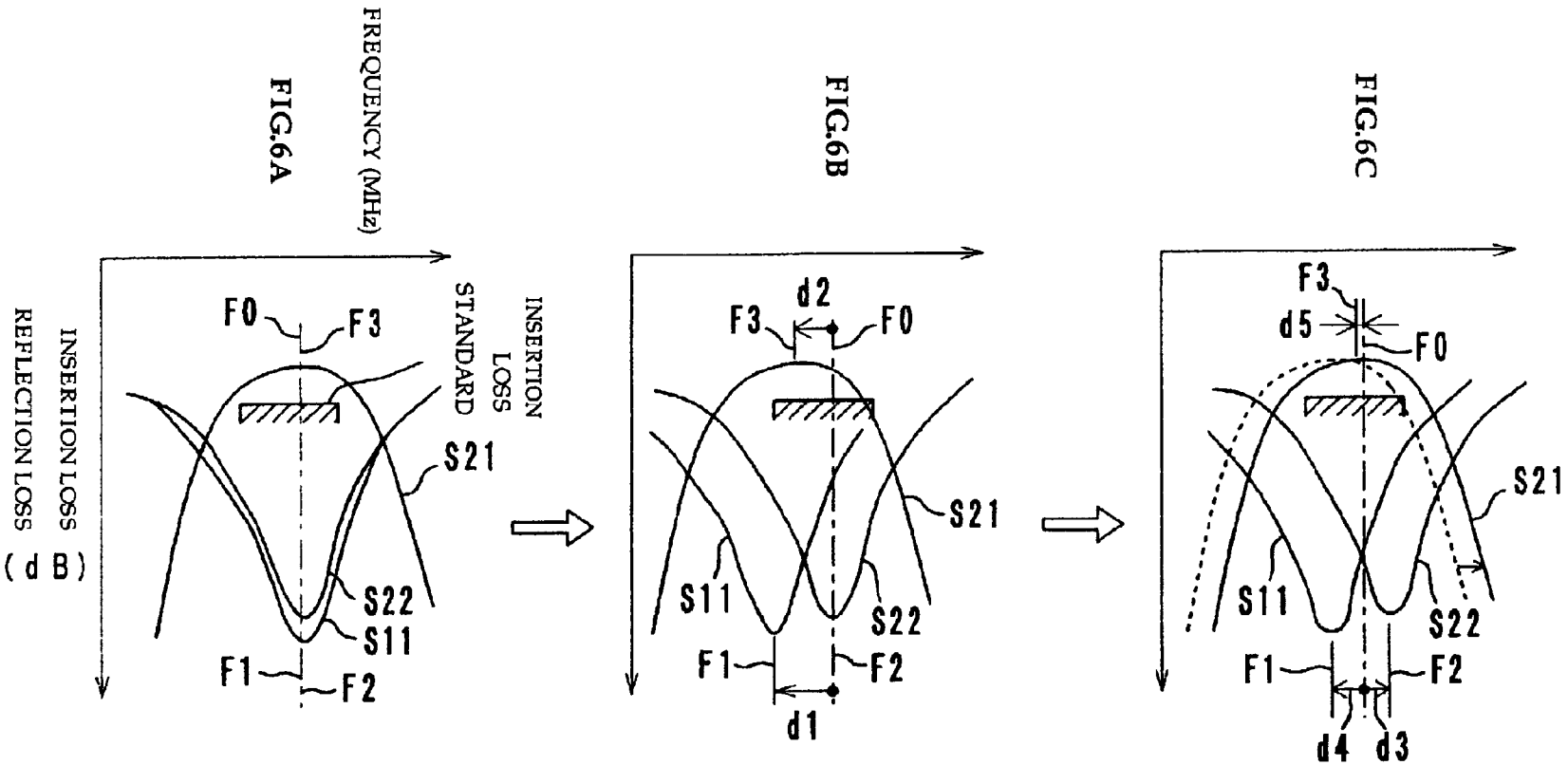
FIGS. 6A to 6C are diagrams showing input impedance matching of the nonreciprocal circuit device in FIG. 1.

Meanwhile, as shown in FIG. 6B, when the input impedance value of the isolator is set at a desirable value by changing only the electrostatic capacitance value of the matching capacitor element C2 on the input terminal 14 side, the frequency F1 at which the input-side reflection loss S11 becomes the maximum value might deviate from the center frequency F0 toward the lower frequency side. In this case, as shown in FIG. 6C, by reducing the electrostatic capacitance of the matching capacitor element C2, the F2 at which the output-side reflection loss S22 becomes the maximum value is caused to be higher than the center frequency F0 by d3. Moreover, by increasing the electrostatic capacitance of the matching capacitor element C1, the frequency F1 at which the input-side reflection loss S11 becomes the maximum value is caused to be lower than the center frequency F0 by d4 (<d1). Thereby, the frequency F3 at which the insertion loss S21 becomes the minimum has only to deviate from the center frequency F0 slightly, and more specifically, by d5 (<d2).

The present invention is not limited to the above-described preferred embodiments. It is to be understood that various changes and modifications may be made thereto without departing from the true spirit and scope of the present invention. For example, the present invention can also be applied to a circulator, in addition to being applied to an isolator in the above-described embodiment.

Also, when input impedance matching of the nonreciprocal circuit device is to be achieved, the impedance matching may be achieved by changing the crossing angles between the center electrodes in the center electrode assembly, without changing the electrostatic capacities of the matching capacitors, or as well as changing the electrostatic capacities of the matching capacitors. In this case also, with respect to the reflection loss characteristic, the center frequency F0 can be set to be located between the frequency F1 at which the input-side reflection loss S11 becomes the maximum and the frequency F2 at which the output-side reflection loss S22 becomes the maximum.

Figure 7:
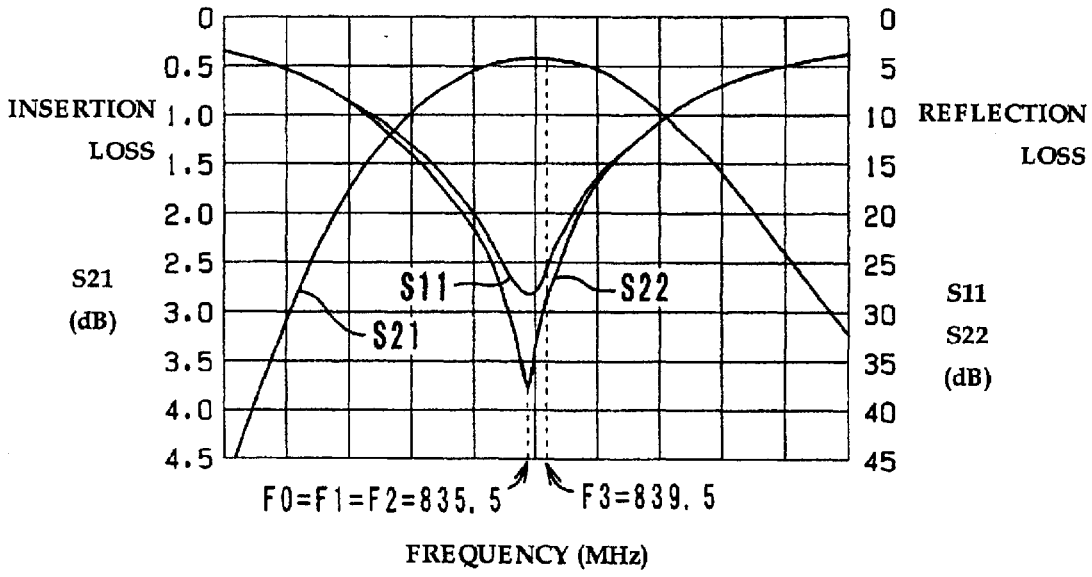
FIG. 7 is a diagram showing the insertion loss characteristic and the input/output reflection loss characteristics of a related nonreciprocal circuit device.
Figure 8:
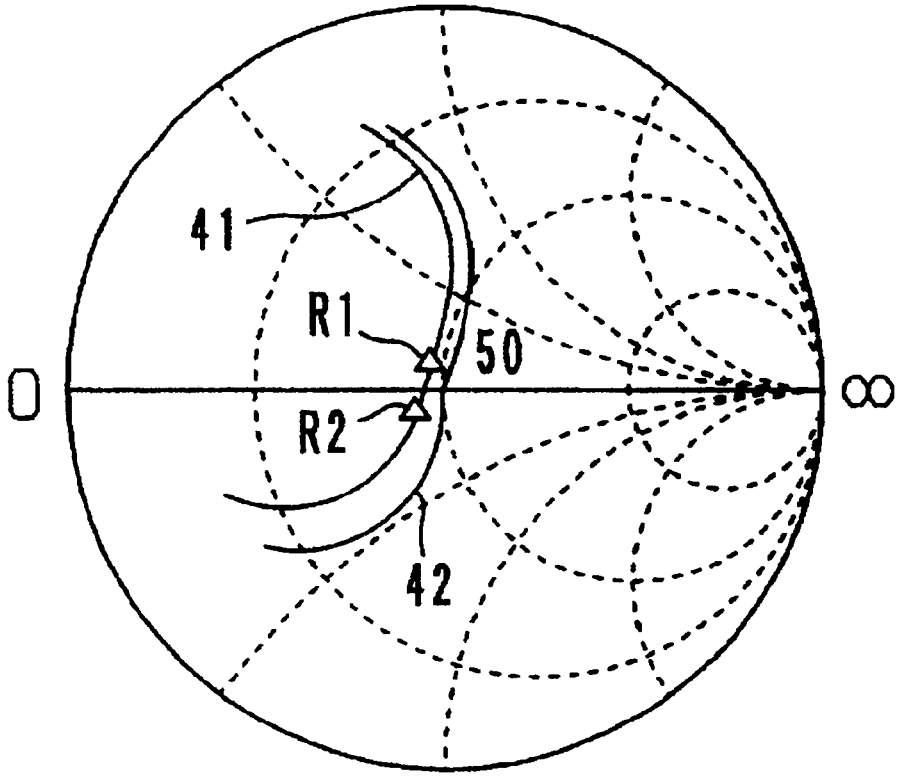
FIG. 8 is a Smith chart for the related nonreciprocal circuit device.

As a related isolator, an isolator was prepared that has arrangement as follows: the crossing angle between the center electrodes 21 and 23 in the center electrode assembly 13 thereof is set at an angle of approximately 120.5 degrees, that between the center electrodes 23 and 22 is set at an angle of approximately 119.5 degrees, and that between the center electrodes 21 and 22 is set at an angle of approximately 120.0 degrees, and also, the electrostatic capacities of the matching capacitors elements C1, C2, and C3, respectively, are set at about 13.65 pF, about 15.65 pF, and about 16.50 pF so that, at the center frequency F0, the insertion loss S21 becomes the minimum value, and the input-side and output-side reflection losses S11 and S22 become the maximum value. FIG. 7 shows the insertion loss characteristic and the input/output reflection loss characteristics of this related isolator, and FIG. 8 shows a Smith chart thereof. In FIG. 8, the solid line 41 shows the input impedance characteristic of the related isolator, and the solid line 42 shows the output impedance characteristic thereof.

As shown in FIG. 8, in the related isolator, the real part of the input impedance R1 at about 824 MHz is about 47.4 Ω, while the real part of the input impedance R2 at about 849 MHz is about 43.3 Ω. As a result, the impedance difference between the real parts of the input impedances R1 and R2 at about 824 MHz and about 849 MHz becomes approximately 4 Ω, thereby causing the real part of the input impedance R2 at about 849 MHz to significantly fall outside of 50 Ω.

Suppose that it is necessary to set the both real parts of the input impedances at about 824 MHz and about 849 MHz to be in the range of approximately 48±2 Ω in order to achieve impedance matching between the related isolator and a next-stage electric circuit thereof. Then, even though the value of the input impedance of the isolator is set at a desirable value by changing only the electrostatic capacitance value of the matching capacitor element C1 on the input terminal side to an appropriate value, the insertion loss S21 thereof falls outside the insertion loss standard, thereby not allowing the related isolator to be used.

Figure 9:
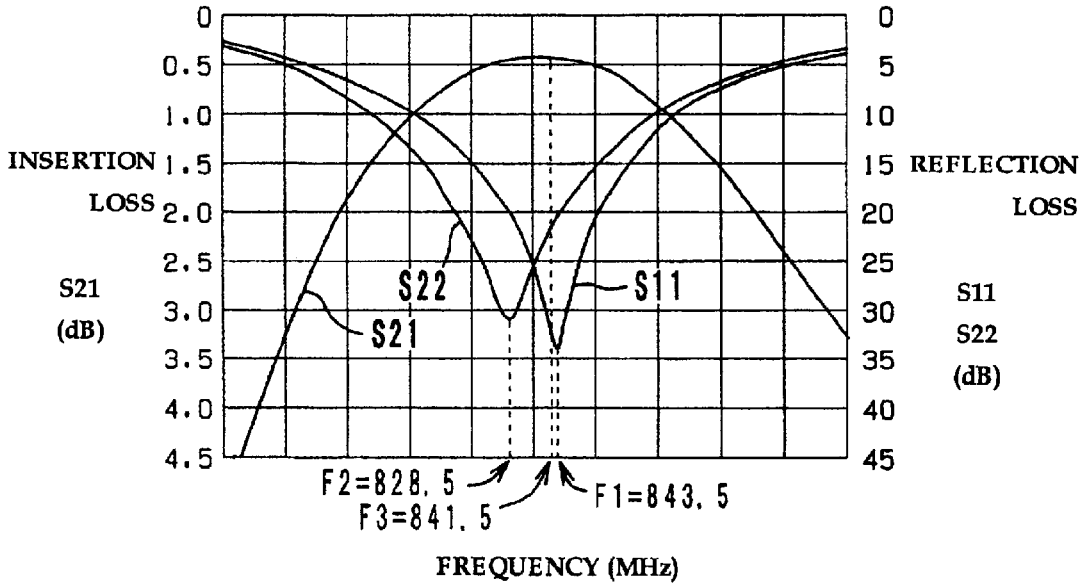
FIG. 9 is a diagram showing the insertion loss characteristic and the input/output reflection loss characteristics of the nonreciprocal circuit device according to preferred embodiments of the present invention.
Figure 10:
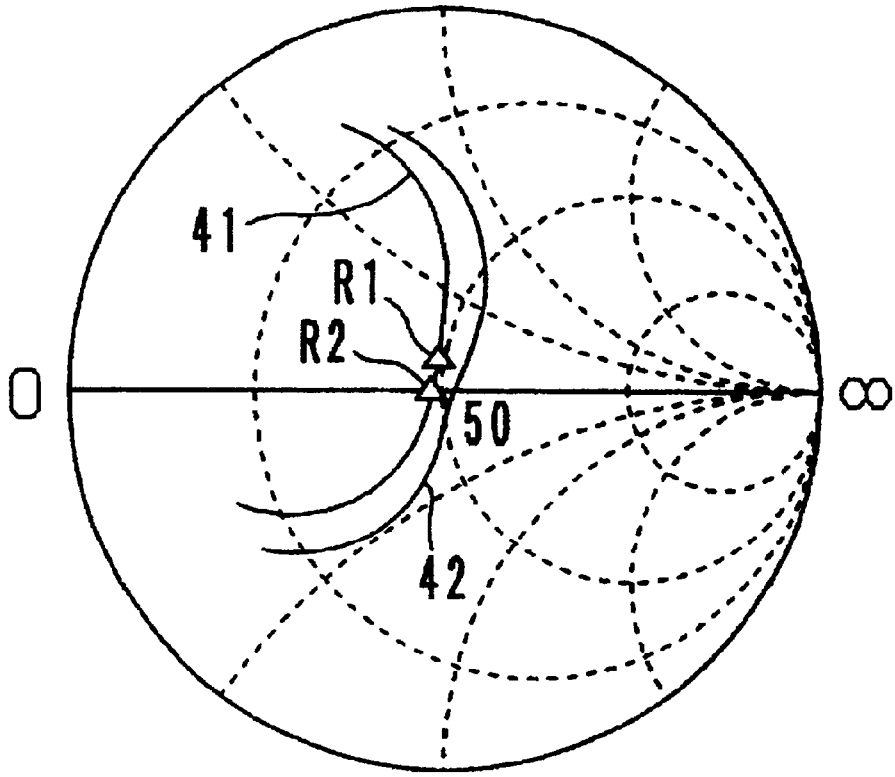
FIG. 10 is a Smith chart for the nonreciprocal circuit device according to preferred embodiments of the present invention.

In contrast, the isolator 1 according to preferred embodiments of the present invention could achieve the characteristics shown in FIGS. 9 and 10 by changing the value of the matching capacitor element C1 on the input terminal 14 side from about 13.65 pF to about 13.45 pF, and changing the value of the matching capacitor element C2 on the output terminal 15 side from about 15.65 pF to about 15.85 pF, with other configurations and conditions being the same as those of the related isolator. As shown in FIG. 10, in the isolator according to a preferred embodiment of the present invention 1, the real part of the input impedance R1 at about 824 MHz is about 48.5 Ω, while the real part of the input impedance R2 at about 849 MHz is about 47.2 Ω. As a consequence, the impedance difference between the real parts of the input impedances R1 and R2 at about 824 MHz and about 849 MHz becomes approximately 1.3 Ω, thereby bringing the real part of the input impedance R2 close to approximately 50 Ω. At this time, the difference between the frequencies F1 and F2 at which the input/output reflection losses S11 and S22 become the maximum values is (843.5 MHz−828.5 MHz)=15 MHz, while, in the case of the related isolator, this difference is 0 MHz. Herein, the isolator 1 according to preferred embodiments of the present invention has been changed merely in the electrostatic capacitance of the matching capacitor elements C1 and C2 as compared with the related isolator, and has not been changed in the structural design.

As is evident from the foregoing, when input impedance matching of the nonreciprocal circuit device is to be achieved, with respect to the reflection loss characteristic, the electrostatic capacities of the matching capacitors or the crossing angles between the center electrodes are appropriately adjusted so that the center frequency in a pass band is located between the frequency at which the input-side reflection loss becomes the maximum value and the frequency at which the output-side reflection loss becomes the maximum value. Thereby, the frequency at which insertion loss becomes the minimum value is close to the center frequency, thereby satisfying the required insertion loss. This allows the input impedance value to be set at a desirable value without the need to change the configuration of the inner components of the nonreciprocal circuit device, resulting in a reduced manufacturing cost.

Moreover, by incorporating the nonreciprocal circuit device having the above-described features into a communication apparatus such as a portable telephone, it is possible to provide a communication apparatus that has a greatly improved matching with a next-stage electric circuit, and that has a reduced power consumption.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A nonreciprocal circuit device, comprising:

nonreciprocal circuit elements including:

a first frequency, at which an input-side reflection loss is a maximum value, is lower or higher than a center frequency in a pass band; and a second frequency, at which an output-side reflection loss is a maximum value, is higher or lower than the center frequency; wherein the center frequency is located between the first frequency and the second frequency.

2. The nonreciprocal circuit device according to claim 1, wherein the nonreciprocal circuit device is a concentrated constant type isolator.

3. The nonreciprocal circuit device according to claim 1, further comprising an upper member, a lower member, a resin case, a center electrode assembly, a permanent magnet, a resistor element, matching capacitors, and a resin member.

4. The nonreciprocal circuit device according to claim 1, further comprising:

a permanent magnet;

a center electrode assembly which has a ferrite member, and a plurality of center electrodes disposed on the surface of the ferrite member so as to cross each other at predetermined angles, and to which a DC magnetic field is applied by the permanent magnet;

a metallic case having the permanent magnet and the center electrode assembly disposed therein; and matching capacitors electrically connected to the center electrode assembly.

5. The nonreciprocal circuit device according to claim 4, wherein the electrostatic capacities of the matching capacitors are set such that the first frequency is lower or higher than the center frequency in a pass band, and the second frequency is higher or lower than the center frequency.

6. The nonreciprocal circuit device according to claim 4, wherein the crossing angle between the center electrodes is set such that the first frequency is lower or higher than the center frequency in a pass band, and the second frequency is higher or lower than the center frequency.

7. The nonreciprocal circuit device according to claim 6, wherein the crossing angle between the center electrodes is about 120 degrees.

8. A communications apparatus comprising the nonreciprocal circuit device according to claim 1.

9. The communications apparatus according to claim 8, wherein the communications apparatus is a portable telephone.

10. A nonreciprocal circuit device comprising:

a permanent magnet;

a center electrode assembly which has a ferrite member, and a plurality of center electrodes disposed on the surface of the ferrite member so as to cross each other at predetermined crossing angles, and to which a DC magnetic field is applied by the permanent magnet;

a metallic case having the permanent magnet and the center electrode assembly disposed therein; and matching capacitors electrically connected to the center electrode assembly; wherein the electrostatic capacities of the matching capacitors are set such that a first frequency, at which an input-side reflection loss is a maximum value, is lower or higher than the center frequency in a pass band, and a second frequency, at which an output-side reflection loss is a maximum value, is higher or lower than the center frequency, and the center frequency is located between the first frequency and the second frequency.

11. The nonreciprocal circuit device according to claim 10, wherein the nonreciprocal circuit device is a concentrated constant type isolator.

12. The nonreciprocal circuit device according to claim 10, wherein the crossing angle between the center electrodes is set such that the first frequency is lower or higher than the center frequency in a pass band, and the second frequency is higher or lower than the center frequency.

13. The nonreciprocal circuit device according to claim 12, wherein the crossing angle between the center electrodes is about 120 degrees.

14. A communications apparatus comprising the nonreciprocal circuit device according to claim 10.

15. The communications apparatus according to claim 14, wherein the communications apparatus is a portable telephone.

16. A nonreciprocal circuit device comprising:

a permanent magnet;

a center electrode assembly which has a ferrite member, and a plurality of center electrodes disposed on the surface of the ferrite member so as to cross each other at predetermined angles, and to which a DC magnetic field is applied by the permanent magnet;

a metallic case having the permanent magnet and the center electrode assembly disposed therein; and matching capacitors electrically connected to the center electrode assembly; wherein the crossing angle between the center electrodes is set such that a first frequency, at which an input-side reflection loss is a maximum value, is lower or higher than the center frequency in a pass band, and a second frequency, at which an output-side reflection loss is a maximum value, is higher or lower than the center frequency, and the center frequency is located between the first frequency and the second frequency.

17. The nonreciprocal circuit device according to claim 16, wherein the nonreciprocal circuit device is a concentrated constant type isolator.

18. The nonreciprocal circuit device according to claim 16, wherein the electrostatic capacities of the matching capacitors are set such that the first frequency is lower or higher than the center frequency in a pass band, and the second frequency is higher or lower than the center frequency.

19. The nonreciprocal circuit device according to claim 16, wherein th crossing angle between the center electrodes is about 120 degrees.

20. A communications apparatus comprising the nonreciprocal circuit device according to claim 16.

21. The communications apparatus according to claim 20, wherein the communications apparatus is a portable telephone.

* * * * *